United States Patent [19]

McCue et al.

[11] Patent Number: 4,631,649

[45] Date of Patent: Dec. 23, 1986

[54] PLUG-IN EMERGENCY LIGHT FIXTURE

[75] Inventors: Robert J. McCue; Ronald H. Minter, both of Guilford, Conn.

[73] Assignee: Chloride Systems, a division of Chloride Power Electronics, Incorporated, El Paso, Tex.

[21] Appl. No.: 788,033

[22] Filed: Oct. 16, 1985

[51] Int. Cl.[4] ..... F21L 7/00

[52] U.S. Cl. ..... 362/183; 362/191; 362/20

[58] Field of Search ..... 362/183, 190, 191, 20; 315/156, 86

[56] References Cited

U.S. PATENT DOCUMENTS

| | | | |
|---|---|---|---|
| 3,125,300 | 3/1964 | Roche | 362/20 |
| 3,233,091 | 2/1966 | Hunt | 362/183 |
| 3,739,226 | 6/1973 | Seiter et al. | 362/20 |
| 4,255,746 | 3/1982 | Johnson et al. | 362/183 |
| 4,345,304 | 8/1982 | Penney et al. | 362/183 |
| 4,461,974 | 7/1984 | Chiu | 362/12 |
| 4,535,391 | 8/1985 | Hsiao | 362/183 |

*Primary Examiner*—E. Rollins Cross

*Attorney, Agent, or Firm*—Finnegan, Henderson, Farabow, Garrett & Dunner

[57] ABSTRACT

An emergency light fixture is permanently mountable in a conventional power outlet box having, in fixed relation, a threaded bore for accommodating a screw for a face plate and slots for accommodating an electric plug. The emergency light fixture includes a housing, an electric plug extending from the rear wall of the housing, a battery, a battery charger, and a lamp mounted in the housing and wired to provide illumination during a power outage. The fixture also includes an aperture in the rear wall of the housing for accommodating a screw for permanently attaching the housing to the outlet box. The aperture is in fixed relationship with the electric plug so that the aperture is aligned with the threaded bore in the outlet box when the electric plug is aligned with the slots in the outlet box.

4 Claims, 1 Drawing Figure

PLUG-IN EMERGENCY LIGHT FIXTURE

BACKGROUND OF THE INVENTION

1. Field of the Invention

The present invention relates to emergency light fixtures.

2. Description of the Related Art

Emergency light fixtures are now required to be installed in public places such as hotel rooms in order to provide like in case of a power failure which cuts off the electricity to the normal lighting system. Rigid building codes require such emergency light fixtures to be permanently installed so that they cannot be removed by unauthorized personnel. Typical emergency light fixtures require customized design to accommodate the location in which they are installed and require skilled electricians to install the fixtures. In addition, if a building needs to be retrofitted for emergency light fixtures, additional wiring and alteration of the walls is required.

The requirement that emergency light fixtures be permanently installed so that they cannot be removed by unauthorized personnel has produced a variety of drawbacks. Since the emergency light fixtures must be custom designed to accommodate an appropriate location, they are expensive to manufacture. In addition, because the emergency light fixtures must be installed by a skilled electrician or other trained workers in order to connect the emergency light system to the electrical system of the building and mount it on the walls of a building, the labor costs are quite high.

It is an object of the present invention to provide an emergency light fixture which is of simple design and which can be manufactured in high quantities for low cost.

It is another object of the present invention to provide an emergency light fixture which can be permanently installed by an unskilled laborer without the need for an electrician or other skilled personnel in such a manner that it cannot be removed by unauthorized personnel.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided an emergency light fixture permanently mountable in a conventional power outlet box having in fixed relation a threaded bore for accommodating a screw for a face plate and slots for accommodating an electric plug, the emergency light fixture comprising: a housing; an electric plug extending from the rear wall of the housing; a battery mounted in the housing; a lamp mounted in the housing and connected to the battery for illumination during a power outage; charging means connected to the electric plug and the battery for charging the battery; aperture means in the rear wall of the housing for accommodating a screw for permanently attaching the housing to the outlet box, the aperture means being in fixed relationship with the electric plug so that the aperture means is aligned with a threaded bore in the outlet box when the electric plug is aligned with the slots in the outlet box.

It is preferable that the screw for permanently attaching the housing to the outlet box has a tamperproof engaging means for engagement with a screwdriver. It is also preferable that the housing includes a removable panel means for allowing, when removed, and preventing, when in place, access to the screw for permanently attaching the housing to the outlet box. It is additionally preferable that the removable panel is secured to the remainder of the housing by tamper-proof screws. It is still further preferable that an auxiliary power outlet is mounted in the housing and connected to the electric plug.

BRIEF DESCRIPTION OF THE DRAWINGS

The accompanying drawings, which are incorporated in and constitute a part of the specification, illustrate a preferred embodiment of the invention and, together with the general description of the invention given above and the detailed description of the preferred embodiment below, serve to explain the principles of the invention.

DESCRIPTION OF THE PREFERRED EMBODIMENT

Figure 1:
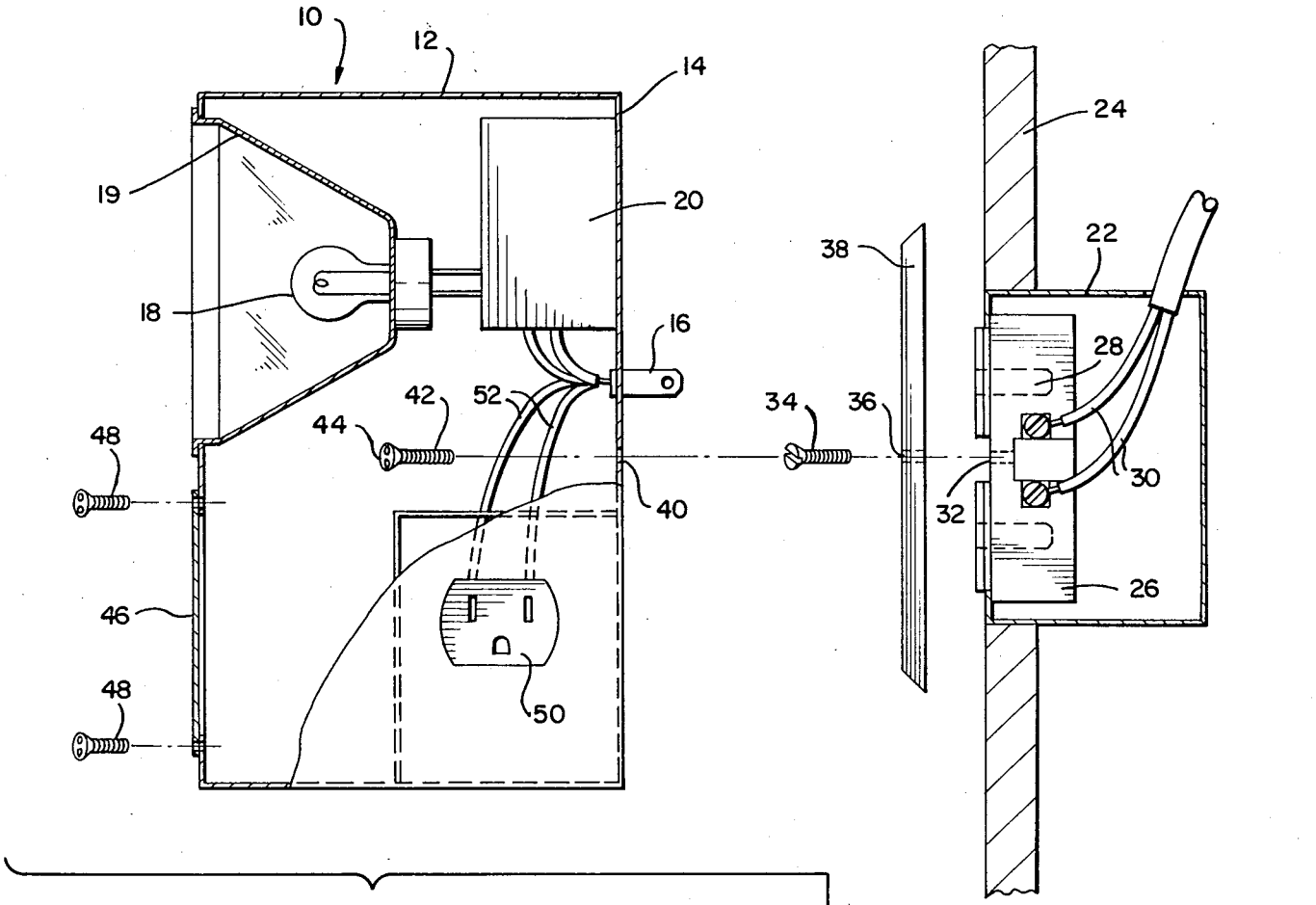
FIG. 1 is a side elevational view of an emergency light fixture incorporating the teachings of the present invention in spaced relationship to a conventional power outlet and with assembly screws shown in an exploded perspective view.

Reference will now be made in detail to the present preferred embodiment of the invention as illustrated in the accompanying drawings.

In accordance with the present invention there is provided an emergency light fixture permanently mountable in a conventional power outlet box having in fixed relation a threaded bore for accommodating a screw for a face plate and slots for accommodating an electric plug, the emergency light fixture comprising: a housing; an electric plug extending from the rear wall of the housing; a battery mounted in the housing; a lamp mounted in the housing in connection to the battery for illumination during a power outage; charging means connected to the electric plug and the battery for charging the battery; aperture means in the rear wall of the housing for accommodating a screw for permanently attaching the housing to the outlet box, the aperture means being in fixed relationship with the electric plug so that the aperture means is aligned with the threaded bore in the outlet box when the electric plug is aligned with the slots in the outlet box.

As shown in FIG. 1, an emergency light fixture 10 includes a housing 12 having a rear wall 14 and a conventional three prong electric plug 16 extending from rear wall 14 of housing 12. A lamp 18 and reflector assembly 19 is mounted in housing 12. A conventional electrical assembly 20 includes charging means such as a battery charger and battery which is wired to plug 16 and lamp 18 so that lamp 18 is illuminated during a power outage and so that the battery is charged by the battery charger while power is applied to electric plug 16. Electric assembly 20 is conventional and known to those skilled in the art. In and of itself, it comprises no part of the present invention.

A conventional outlet box 22 is stationed in a wall 24. The outlet box includes an electric socket 26 having slots 28 for accommodating the electric plus 16. Slots 28 contain conventional electrical contacts which are wired to the building power supply by wires 30. Electric socket 26 includes a threaded bore 32 for accommodating a screw 34 which passes through a hole 36 in a face plate 38 to attach face plate 38 to the front of outlet box 22.

Rear wall 14 of housing 12 includes aperture means such as aperture 40 for accommodating a screw such as service screw 42. Aperture 40 is positioned relative to electric plug 16 so that aperture 40 is aligned with threaded bore 32 in outlet box 22 when electric plug 16 is aligned with slots 28 in outlet box 22.

The screw for permanently engaging the housing to the outlet box has a tamperproof engaging means for engagement with a screwdriver. As shown in FIG. 1, service screw 42 includes a tamperproof engaging means such as a head 44 with two spaced holes for engagement with a screwdriver having a driving portion which accommodates such an arrangement. In such a manner, service screw 42 cannot be removed with conventional slotted or phillips head screwdrivers by unauthorized personnel.

Housing 12 includes a removable panel means such as removable panel 46 for allowing, when removed, and preventing, when in place, access to service screw 42 for permanently attaching housing 12 to outlet box 22. Removable panel 46 is secured to the remainder of housing 12 by panel screws 48 having tamperproof engaging means similar to head 44 on service screw 42.

An auxiliary power outlet 50 is mounted in housing 12 and connected to electric plug 16 by wires 52. The auxiliary power outlet 50 can be used to accommodate plugs of appliances which would otherwise be accommodated by outlet box 22 in the absence of emergency light fixture 10.

The method for mounting emergency light fixture 10 on outlet box 22 will now be described.

Face plate screw 34 is removed from threaded bore 32 by unscrewing it with the special screwdriver. Face plate 38 is then removed from outlet box 22. The electric plug 16 is inserted into slots 28 of socket 26 in outlet box 22. Service screw 42 is inserted through aperture 40 in the rear of fixture housing 12 and into threaded bore 32 in outlet box 22. The head 44 of service screw 42 is tightened with a screwdriver having a portion which mates with head 44. Emergency light fixture 10 is thereby permanently mounted on a conventional power outlet box 22 without the need for an electrician or other skilled labor. Removable panel 46 is then assembled to the remainder of housing 12 through the use of screws 48 which also have tamperproof heads. Therefore, the emergency light fixture is permanently mounted in place and can only be removed by an authorized service person.

Additional advantages and modifications will readily occur to those skilled in the art. The invention and its broader aspects is, therefore, not limited to the specific details, representative apparatus and illustrative examples shown and described. Accordingly, departures may be made from such details without departing from the spirit or scope of applicant's general inventive concept.

What is claimed is:

1. An emergency light fixture permanently mountable in a conventional power outlet box having in fixed relation a threaded bore for accommodating a screw for a face plate and slots for accommodating an electric plug, the emergency light fixture comprising:

a housing;

an electric plug extending from the rear wall of the housing;

a battery mounted in the housing;

a lamp mounted in the housing and connected to the battery for illumination during a power outage;

charging means connected to the electric plug and the battery for charging the battery;

a tamperproof screw for permanently attaching the housing to the outlet box having a tamperproof engaging means for engagement with a complementary portion of a screwdriver for tamperproof screws and for preventing engagement with conventional slotted or phillips head screwdrivers; and aperture means in the rear wall of the housing for accommodating the screw for permanently attaching the housing to the outlet box, the aperture means being in fixed relationship with the electric plug so that the aperture means is aligned with the threaded bore in the outlet box when the electric plug is aligned with the slots in the outlet box.

2. The emergency light fixture of claim 1 wherein the housing includes a removable panel means for allowing, when removed, and preventing, when in place, access to the screw for permanently attaching the housing to the outlet box.

3. The emergency light fixture of claim 2 wherein the removable panel means is secured to the remainder of the housing by at least one other tamperproof screw having a tamperproof engaging means for engagement with a complementary portion of a screwdriver for tamperproof screws and for preventing engagement with conventional slotted or phillips head screwdrivers.

4. The emergency light fixture of claim 1 include an auxiliary power outlet mounted in the housing and connected to the electric plug.

* * * * *